US005797519A

United States Patent [19]

Schroeder et al.

[11] Patent Number: 5,797,519

[45] Date of Patent: Aug. 25, 1998

[54] POSTMIX BEVERAGE DISPENSER

[75] Inventors: Alfred A. Schroeder, San Antonio, Tex.; Gary V. Paisley, Lilburn, Ga.; Michael T. Romanyszyn, Jr., San Antonio, Tex.

[73] Assignee: The Coca-Cola Company, Atlanta, Ga.

[21] Appl. No.: 818,054

[22] Filed: Mar. 14, 1997

[51] Int. Cl.[6] ..... B67D 5/56

[52] U.S. Cl. ..... 222/129.1; 222/146.6

[58] Field of Search ..... 222/1, 129.1, 129.2, 222/129.3, 129.4, 146.6

[56] References Cited

U.S. PATENT DOCUMENTS

| | | | |
|---|---|---|---|
| Re. 33,943 | 6/1992 | Arzberger et al. | 62/127 |
| 3,323,681 | 6/1967 | DiVette et al. | 222/76 |
| 3,750,908 | 8/1973 | Bauerlein et al. | 222/80 |
| 4,173,296 | 11/1979 | Marshall | 222/129.1 |
| 4,194,650 | 3/1980 | Nottke et al. | 222/57 |
| 4,484,697 | 11/1984 | Fry | 222/95 |
| 4,610,145 | 9/1986 | Arzberger et al. | 62/127 |
| 4,687,120 | 8/1987 | McMillin | 222/1 |
| 4,703,770 | 11/1987 | Arzberger et al. | 137/88 |
| 4,742,939 | 5/1988 | Galockin | 222/146.6 |
| 4,750,645 | 6/1988 | Wilson et al. | 222/145 |
| 4,815,631 | 3/1989 | Eeg et al. | 220/403 |
| 4,856,676 | 8/1989 | Emody | 222/66 |
| 4,979,647 | 12/1990 | Hassell | 222/146.6 |
| 5,000,351 | 3/1991 | Rudick | 222/105 |
| 5,080,261 | 1/1992 | Green | 222/146.6 |
| 5,144,047 | 9/1992 | Baron et al. | 222/129.1 |
| 5,490,614 | 2/1996 | Sardyniski | 222/129.1 |
| 5,535,600 | 7/1996 | Mills | 62/390 |

FOREIGN PATENT DOCUMENTS

| | | | |
|---|---|---|---|
| 2145806 | 6/1996 | Canada . | |
| 509602 | 10/1992 | European Pat. Off. | 222/129.1 |
| 716042A1 | 6/1996 | European Pat. Off. . | |
| 2600875A | 1/1988 | France . | |
| 5-213396 | 8/1993 | Japan . | |
| 5-294394 | 11/1993 | Japan . | |
| 2584572 | 2/1994 | Japan . | |
| 7-54776 | 2/1995 | Japan . | |
| 8-113295 | 5/1996 | Japan . | |
| 8-113297 | 5/1996 | Japan . | |
| 8-167074 | 6/1996 | Japan . | |
| 2589165 | 12/1996 | Japan . | |
| 8-318995 | 12/1996 | Japan . | |
| 9323327 | 11/1993 | WIPO | 222/129.1 |

OTHER PUBLICATIONS

Service Manual for SDM–PXTL, Sanyo Electric Co., Ltd Vending Machine Division (undated).

Specifications and Operating Procedure of PXT Dispenser, Coca–Cola Japan Co. (Aug. 1991).

Post–Mix Juice Dispenser, Installation, Operation and Service Manual, Magnus GmbH (undated).

*Primary Examiner*—Joseph Kaufman

*Attorney, Agent, or Firm*—Dennis W. Braswell

[57] ABSTRACT

A postmix beverage dispenser including a housing, a water bath, a refrigeration system, a concentrate package compartment, a cooling system for the compartment, and a potable water circuit including a cooling coil in the water bath. The concentrate packages are preferably bag-in-box packages with a flexible tube, and the dispenser includes a peristaltic pump driven by a gearhead motor with an encoder. A flow meter in the potable water line feeds information to the control system which controls the pump speed to control ratio. A ratio card is inserted into a slot in the door to tell the control system the ratio to use for each BIB package. A removable water nozzle improves mixing. An improved subassembly and method for making it is described. The potable water cooling coil is above the evaporator coil and separately removable from the water bath.

17 Claims, 13 Drawing Sheets

POSTMIX BEVERAGE DISPENSER

BACKGROUND OF THE INVENTION

This invention relates to postmix beverage dispensers.

Such dispensers are well-known, for mixing a concentrate with water in the desired proportion and dispensing a beverage on demand, such as tea, coffee, juice, etc. Such dispensers have a water bath tank and a refrigeration system for forming an ice bank in the tank. A potable water circuit includes cooling coils in the water bath. A cooled concentrate compartment is provided for holding concentrate. In one known arrangement, the concentrate is in bag-in-box packages having a flexible dispensing tube. The tube is guided through a peristaltic pump. When a beverage is to be dispensed the peristaltic pump and a solenoid valve in the potable water circuit are simultaneously turned on to dispense a beverage.

SUMMARY OF THE INVENTION

A postmix beverage dispenser for dispensing tea, coffee, juice, etc. comprising a housing, a water bath tank, a refrigeration system for forming an ice bank in the water bath, a potable water circuit including a cooling coil in the water bath, a bag-in-box compartment for a plurality of packages, a cooling system for the compartment, a plurality of concentrate pumping units, each including a peristaltic pump driven by a gearhead motor with an encoder, a water meter in the potable water circuit, and a control system for receiving signals from the water meter and for controlling the motor speed in response thereto to provide the desired ratio of water to concentrate.

The invention includes a unique ratio card for each beverage, which card is inserted into a slot in the dispenser. The dispenser control system reads the information on the card regarding what ratio to use for each BIB package. The invention also includes an improved cooling system for the BIB compartment, an easy lift out potable water coil, improved casual drink performance due to an improved potable water circuit, an improved water nozzle, the use of a more powerful gearmotor rather than a stepper motor for the peristaltic pump, an arrangement whereby the major components are serviceable from the front of the dispenser, and a one-piece structural subassembly of the dispenser including the water bath tank, the BIB compartment, a plurality of water conduits, and a layer of insulation surrounding such, and a method for making such subassembly.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
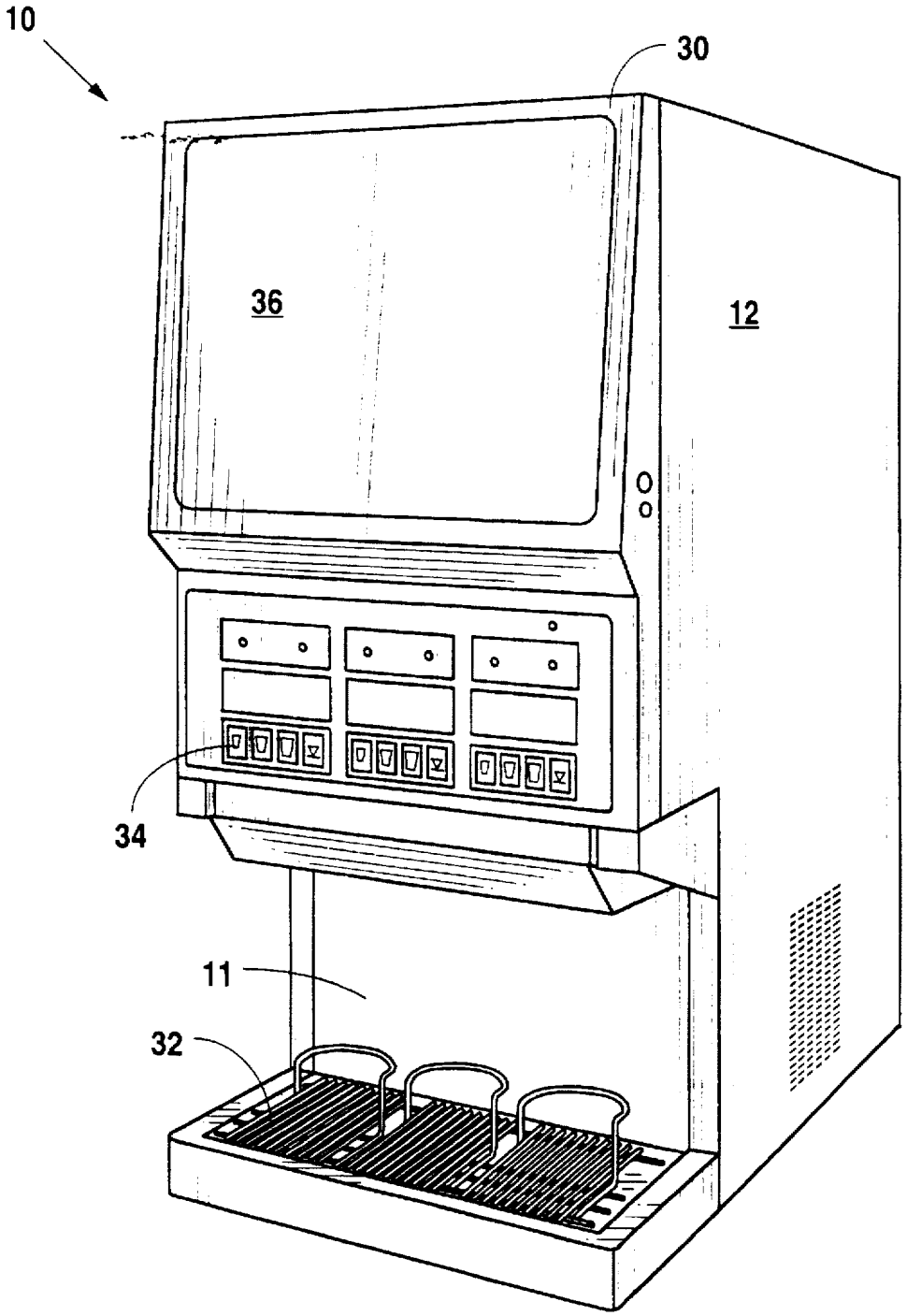
FIG. 1 is a front, right side perspective view of the dispenser of the present invention.

With reference now to the drawings, the postmix beverage dispenser 10 of the present invention comprises a housing 12, a water bath tank 13, a refrigeration system 14 for forming an ice bank in the tank 13, a potable water circuit 16, a compartment 18 for holding a plurality of concentrate packages 20, a plurality of concentrate pumping units 22, a control system 24, and a compartment cooling system 26.

Referring to FIG. 1, the housing 12 includes a front door 30 hinged on the left to provide access to the concentrate compartment. The housing includes a drip tray 32 and preferably three sets of dispense buttons 34, each including a small, medium, large and a pour/cancel, for example. The front of the door includes a back-lighted, removable, graphics panel 36.

Figure 4:
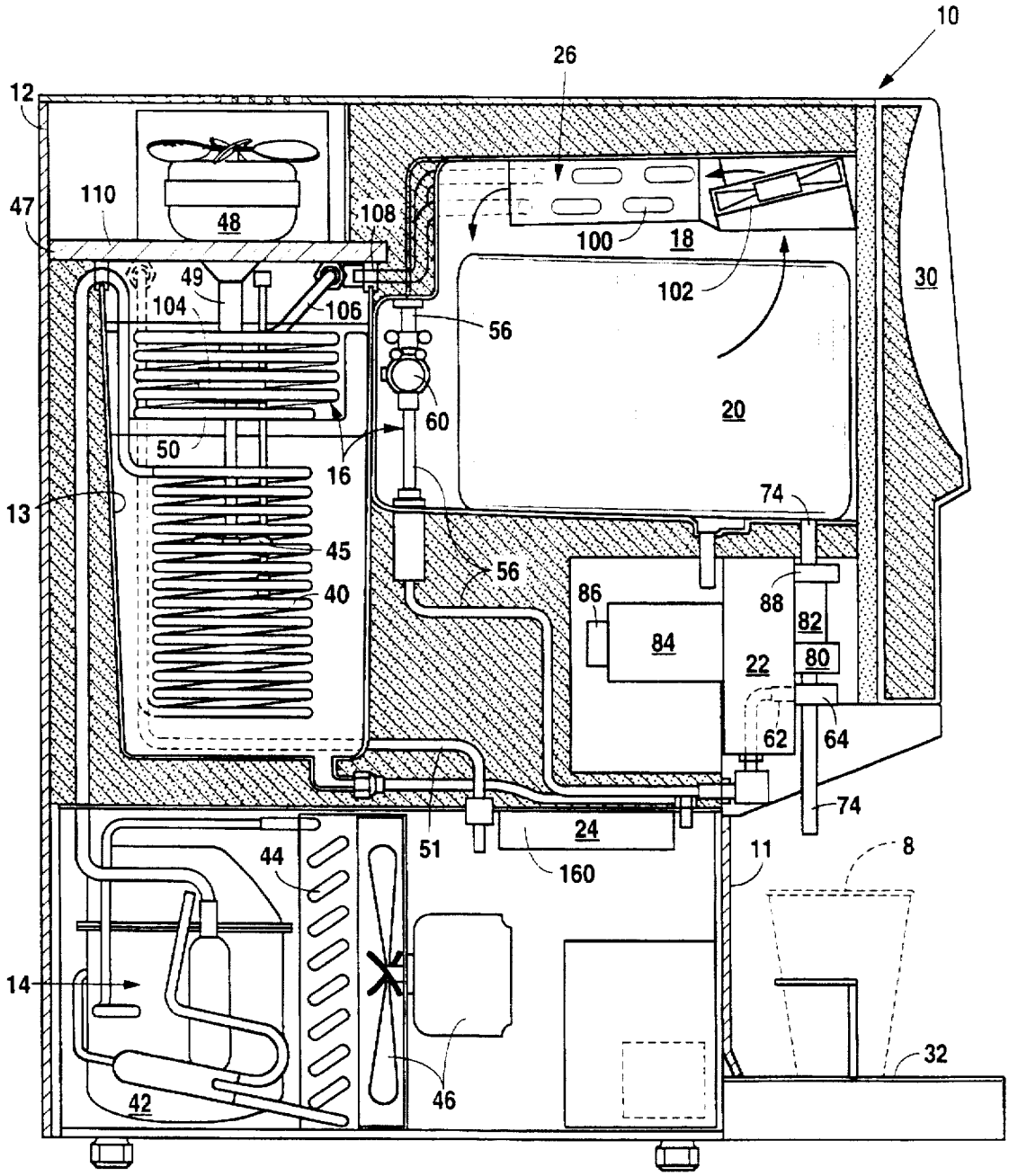
FIG. 4 is a cross-sectional left side view through the dispenser of FIG. 1.

With reference to FIG. 4, the water bath tank 13 is substantially filled with water and the refrigeration system 14 includes the usual evaporator coil 40, compressor 42, condenser 44 and fan-motor 46, as is well-known in this art, for building an ice block around the evaporator coil. A lid or deck 47 is located on top of the tank and supports an agitator motor 48. An agitator shaft 49 extends from the motor down into the water bath to an agitator propeller 45. The pump 104 for the cooling coil 100 in the compartment 18 is also on the shaft 49. The deck 47 can be lifted straight up taking with it the motor 48, shaft 49, etc.

Referring mainly to FIG. 4, the potable water circuit 16 includes a cooling coil 50 located in the tank 13 above the evaporator coil 40. The inlet end of the coil 50 is connected through a coupling 146 to the local water supply by line 51. The water circuit 16 includes a cooled water line 52 extending from a coupling 148 on the outlet of the coil 50 to a manifold 54. Three separate lines 56, corresponding to the three concentrate package stations 58 in the compartment 18, extend from the manifold. Each line 56 goes first to a solenoid/water flow meter assembly 60 (see FIGS. 2 and 4) and then to a female fitting 62 adjacent the corresponding one of the pumping units. The coil 50 can be pulled up out of the tank 13 by disconnecting couplings 146 and 148 and without the need for any disconnecting from the evaporator coil.

Figure 7:
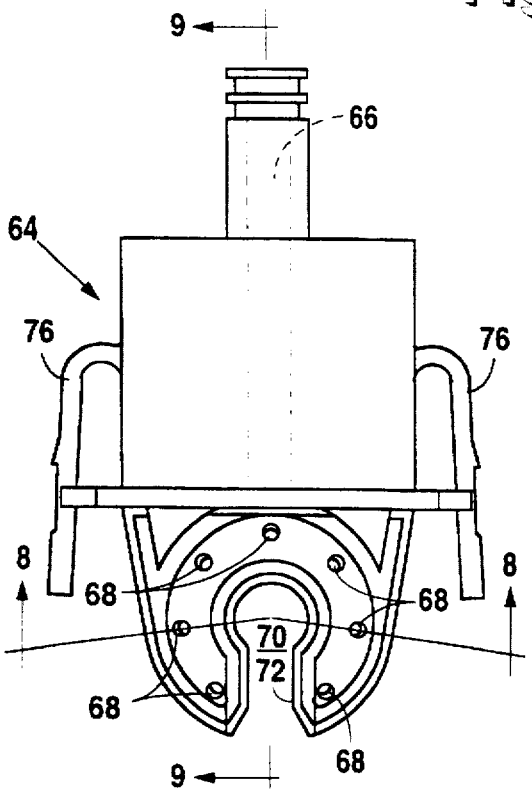
FIG. 7 is a top plan view of the nozzle of the present invention with the cover 77 removed.
Figure 8:
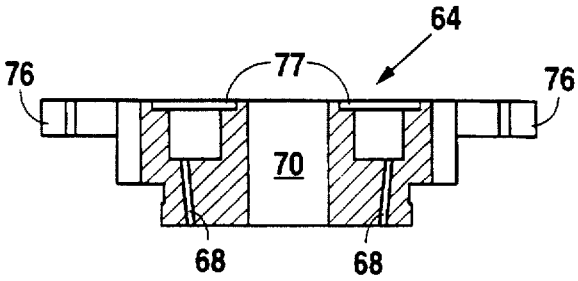
FIG. 8 is a cross-sectional view taken along line 8—8 of FIG. 7.
Figure 9:
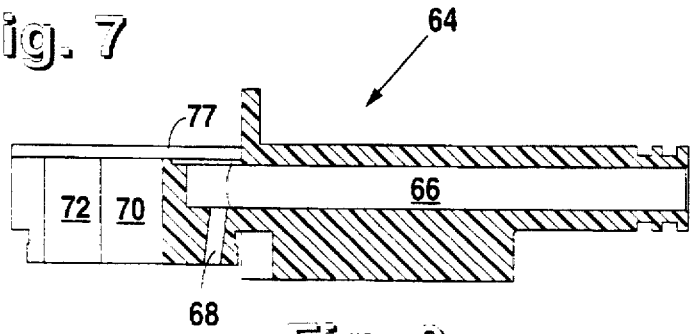
FIG. 9 is a cross-sectional view taken along line 9—9 of FIG. 7.

A removable nozzle 64 (see also FIGS. 5, 7, 8 and 9) plugs into the fitting 62. The nozzle splits the water stream into a plurality of separate streams that angle inwardly toward the center concentrate stream. The nozzle 64 includes a passage 66 and a plurality of circumferentially equally spaced-apart ports 68. The nozzle has a central opening 70 and an access slot 72 for the tube 74 of the concentrate package 20. The nozzle 64 has a pair of flexible arms 76, each with a locking shoulder on the outer surface thereof, that are bent inwardly during insertion and that snap out when released to lock the nozzle in place. The nozzle 64 includes a cover 77 bonded in place. FIG. 7 shows the nozzle 64 with the cover 77 left off, to better show the ports 68.

Figure 2:
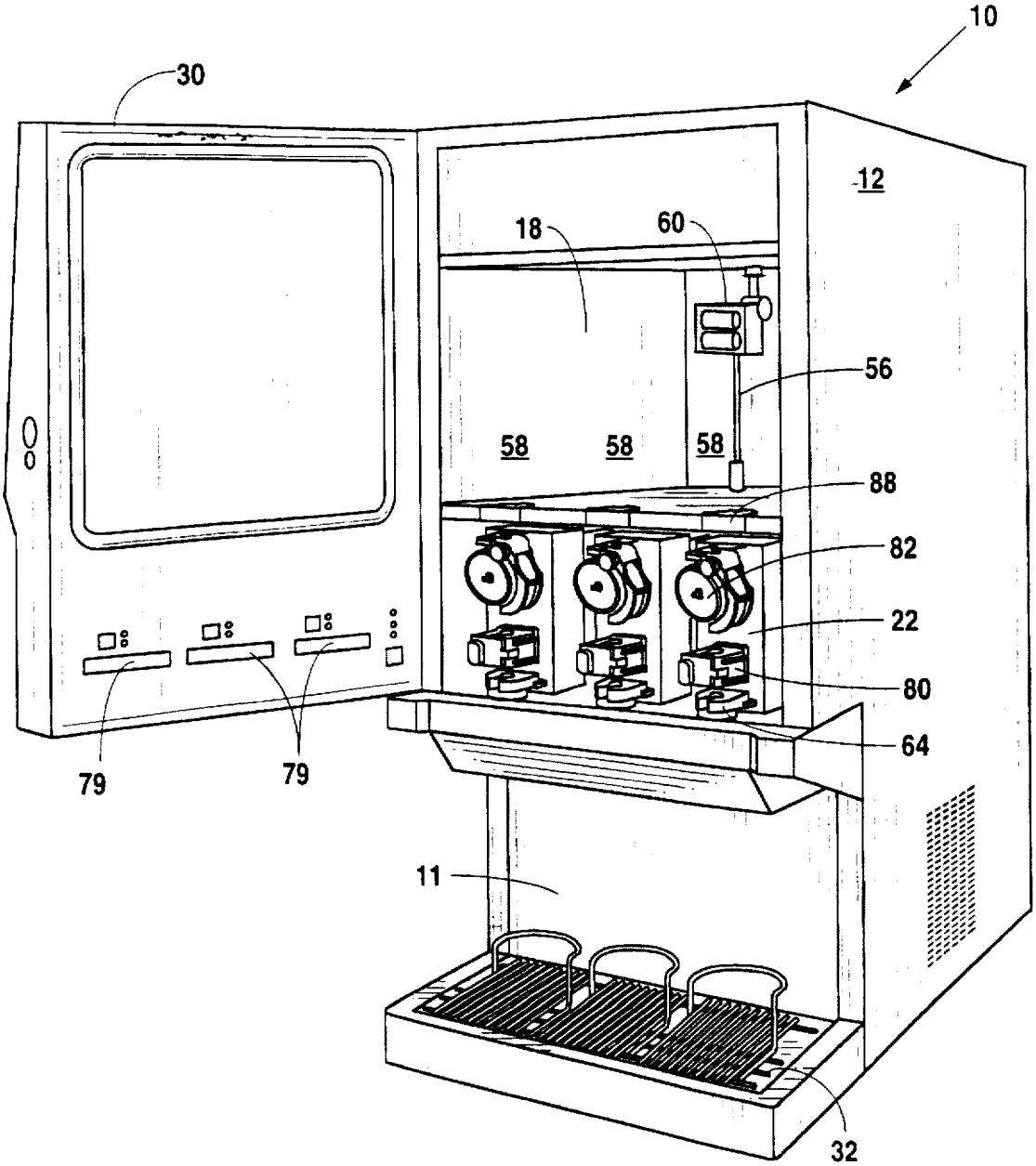
FIG. 2 is a view as in FIG. 1 but with the door open.
Figure 3:
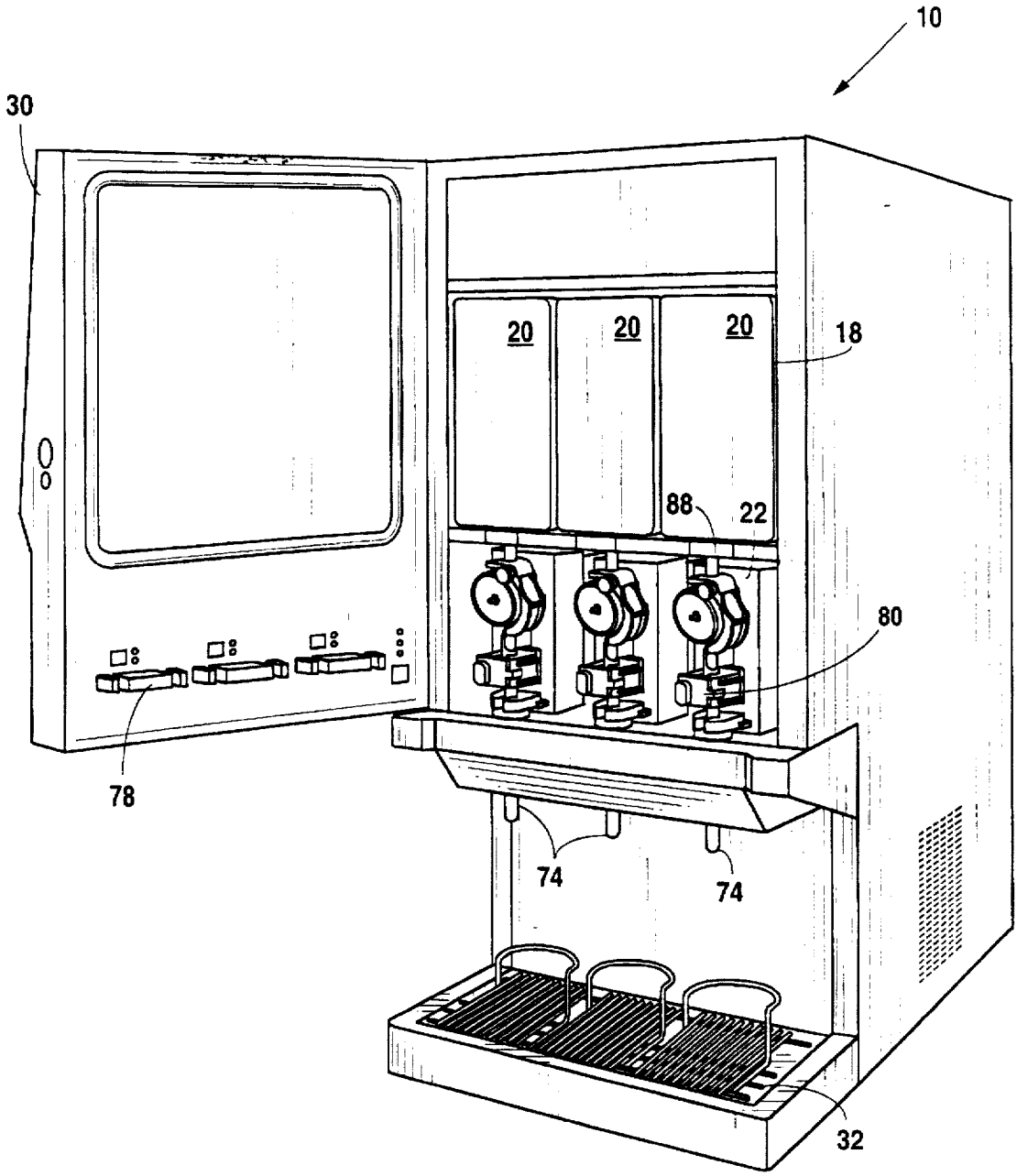
FIG. 3 is a view as in FIG. 2 but with BIB packages inserted into the BIB compartment and with ratio cards inserted into the slots.

Referring mainly to FIGS. 2–4, the compartment 18 is accessed by opening the door 30. It is cooled by the cooling system 26. The packages 20 are slid into place and the dispensing tube is threaded through the pumping unit 22 as described below. A ratio card 78 is inserted into a slot 79 in the rear of the door 30 to tell the control system 24 what the ratio of water to concentrate is to be for product in the package. As can be seen in FIG. 2, the solenoid/water meter assemblies 60 are accessible from the front of the dispenser by being located in the rear of the compartment 18.

The concentrate packages 20 are preferably disposable bag-in-box packages comprising a flexible, collapsible plastic bag inside of a corrugated box. The bag has a fitting to which is attached a flexible, closed end, dispensing tube 74. After the tube 74 is threaded through the pumping unit and the shut-off 80, the closed end is cut off so concentrate can be dispensed upon demand.

Referring to FIG. 4, the housing 12 includes a removable splash plate 11 behind which is located a control box containing much of the electronics for the control system 24.

Figure 5:
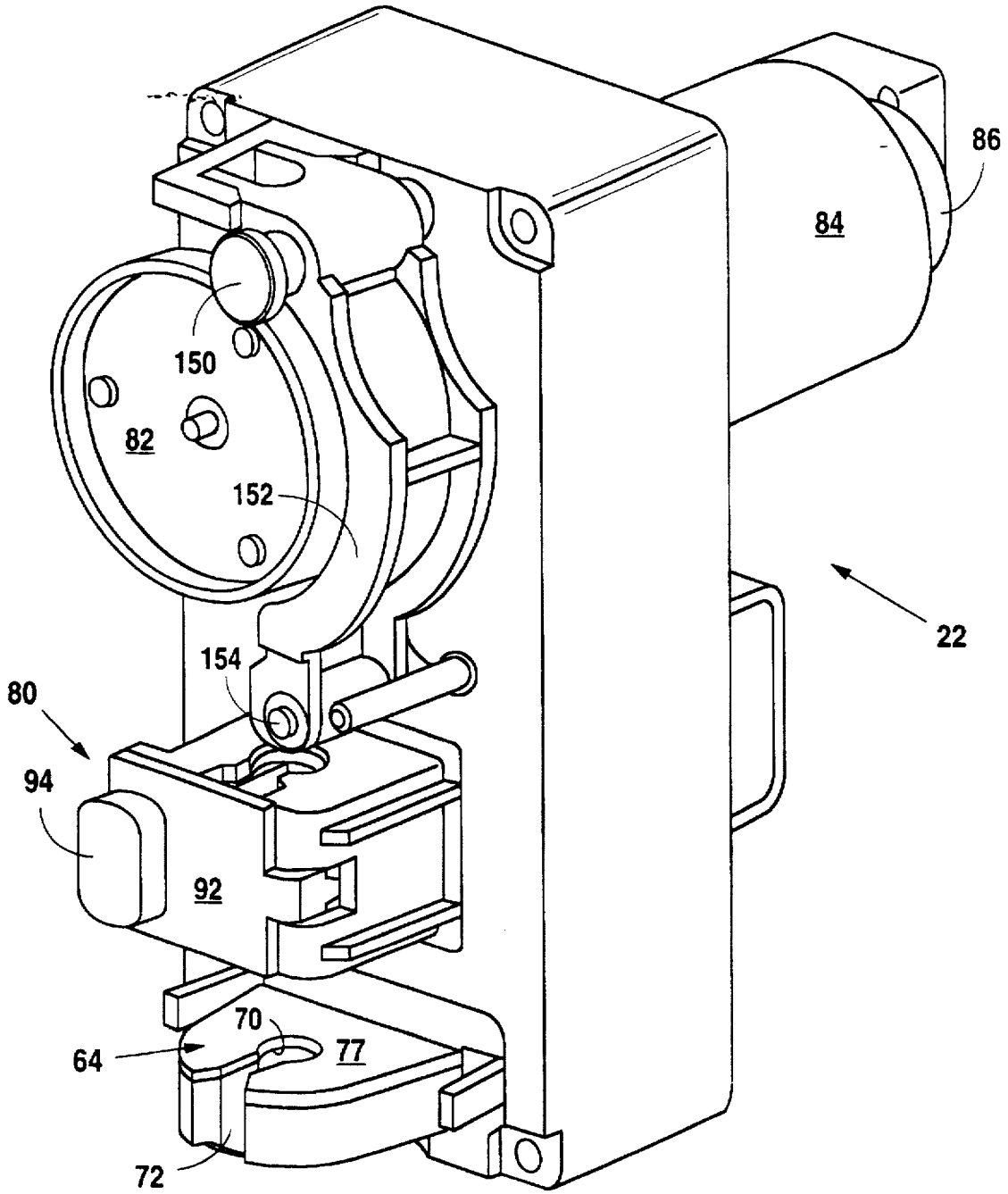
FIG. 5 is a top, front, right side perspective view of the pumping unit of the present invention.
Figure 6:
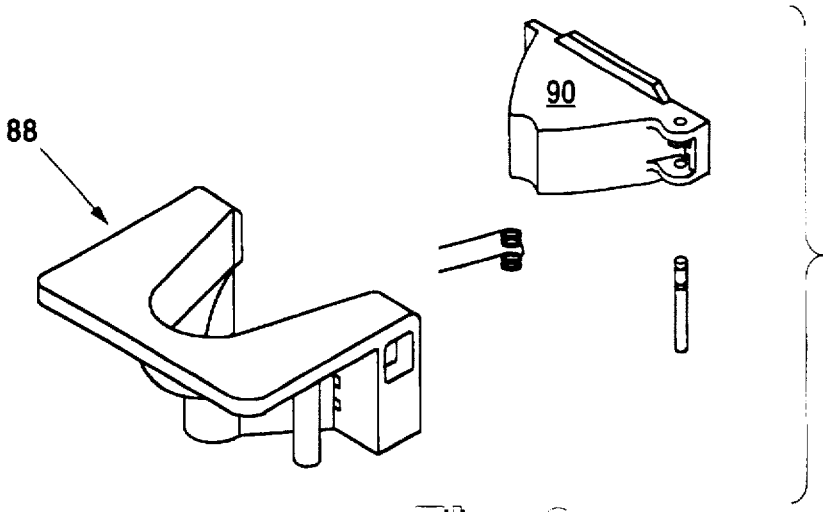
FIG. 6 is a rear perspective, exploded view of the tube guide.

With reference mainly to FIG. 5, the pumping units 22 include a peristaltic pump 82 driven by a gearmotor 84 having an encoder 86. Above the pumping unit is a known tube guide 88 (see FIGS. 2 and 6) having a spring biased, swing-out, front plate 90. Below the pumping unit 22 is a known pinch solenoid operated tube shut-off 80 with a front door 92 having a turnable locking latch 94.

With best reference to FIG. 4, the compartment cooling system 26 includes a compartment cooling coil 100 located in the top of the compartment 18, a fan/motor unit 102 for circulating air through the coil 100 and around the compartment, a pump 104 located in the water bath and driven by the shaft 49, a water inlet line 106 from the pump 104 to the coil 100, and a water return line 108 from the coil to the tank. The lines 106 and 108 are at all times either in insulation or in the tank 13, so there is no sweating and no dripping of water anyplace other than possibly back into the tank 13. In previous dispensers, these lines were in the air above the deck 110 and deleterious sweating and dripping occurred.

Figure 10:
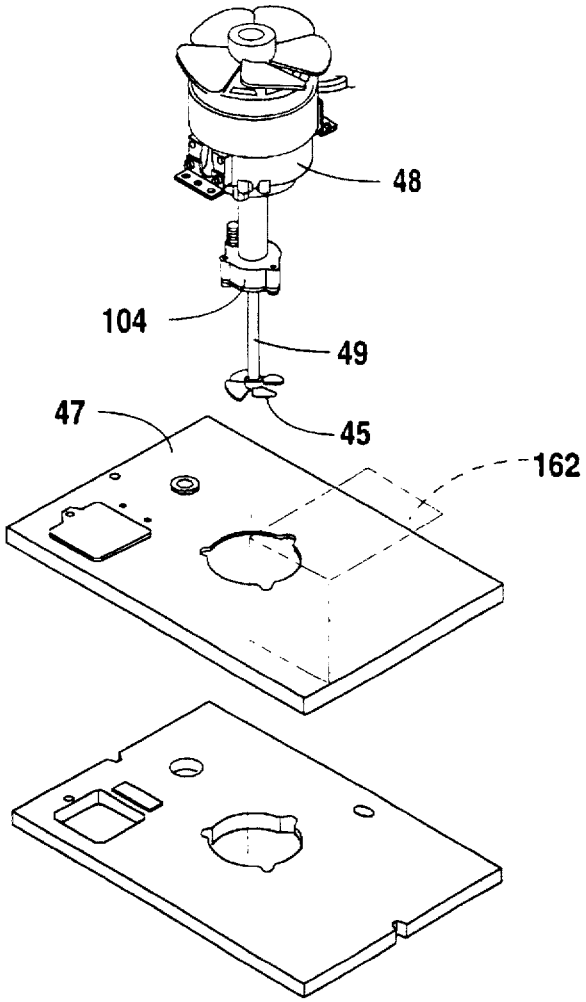
FIG. 10 is an exploded perspective view of the refrigeration deck.

FIG. 10 is an exploded view of the refrigeration deck showing the deck 47, the motor 48 , the shaft 49, and the pump 104.

Figure 11:
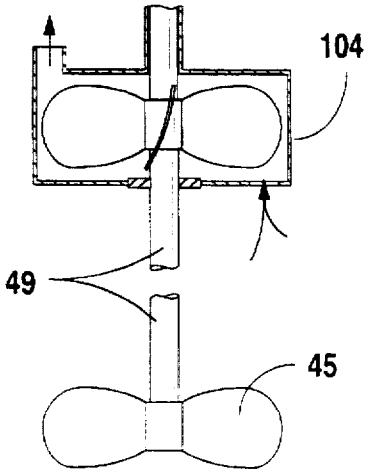
FIG. 11 is a partial side view of the agitator shaft 49.

FIG. 11 shows the shaft 49 connected to the agitator propeller 45 and to the pump 104.

Figure 12:
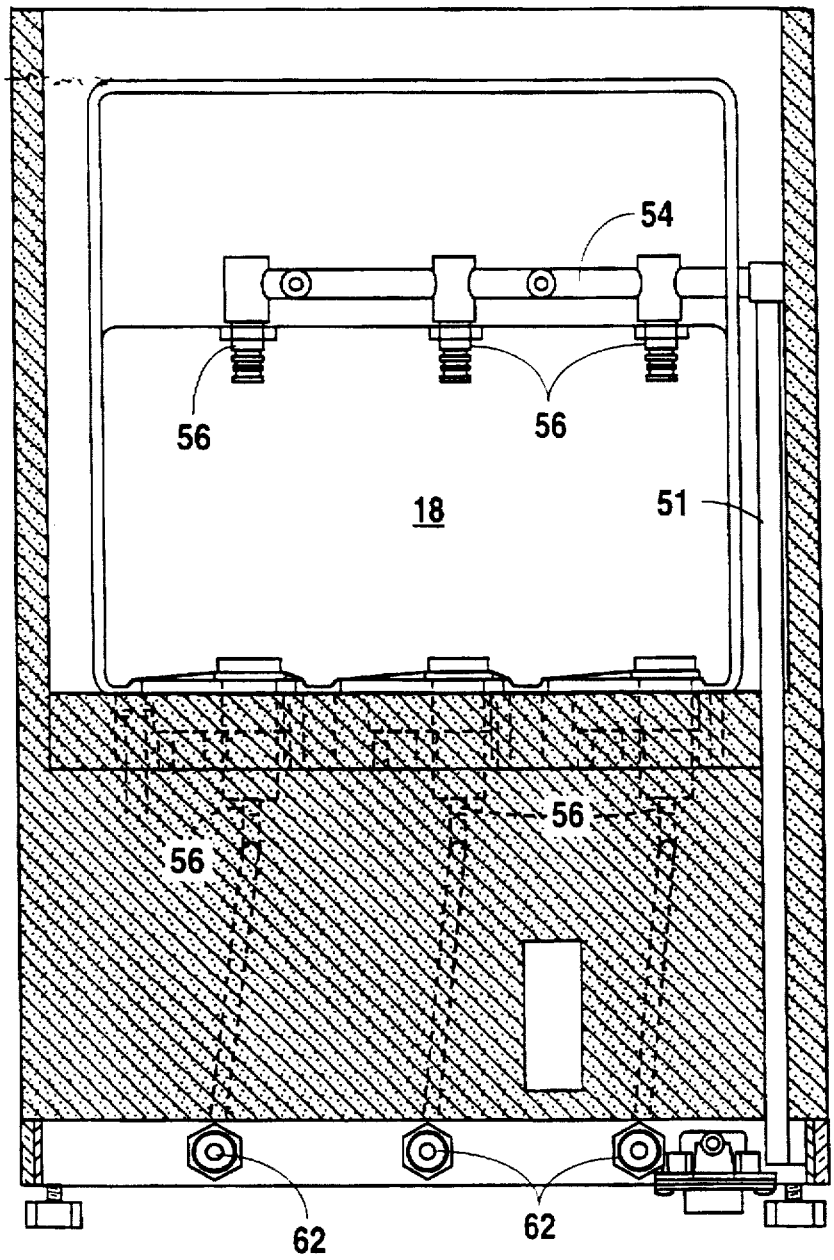
FIG. 12 is a cross-sectional front view through a structural subassembly of this invention.
Figure 13:
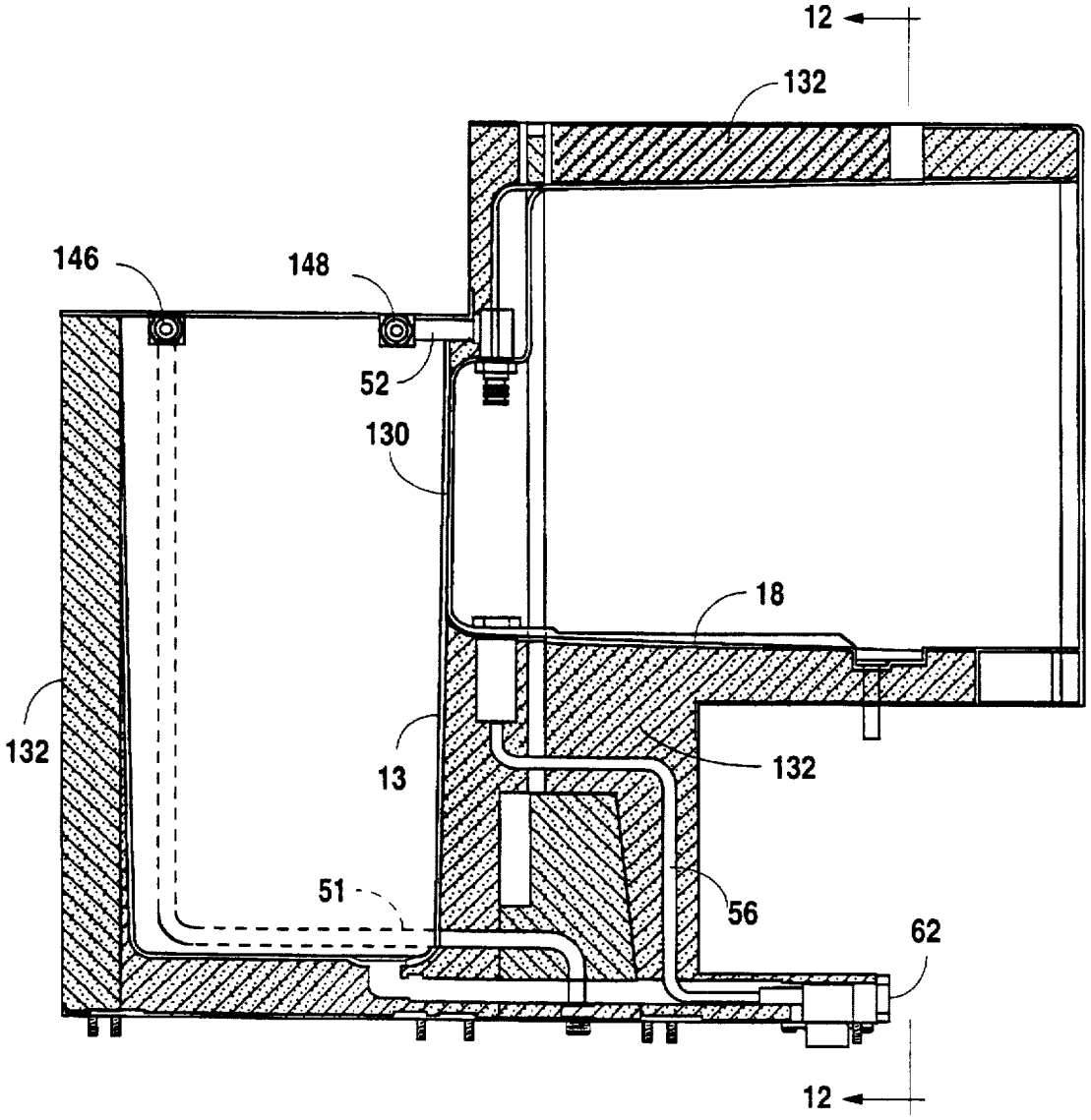
FIG. 13 is a cross-sectional, side view through the subassembly of FIG. 12.
Figure 17:
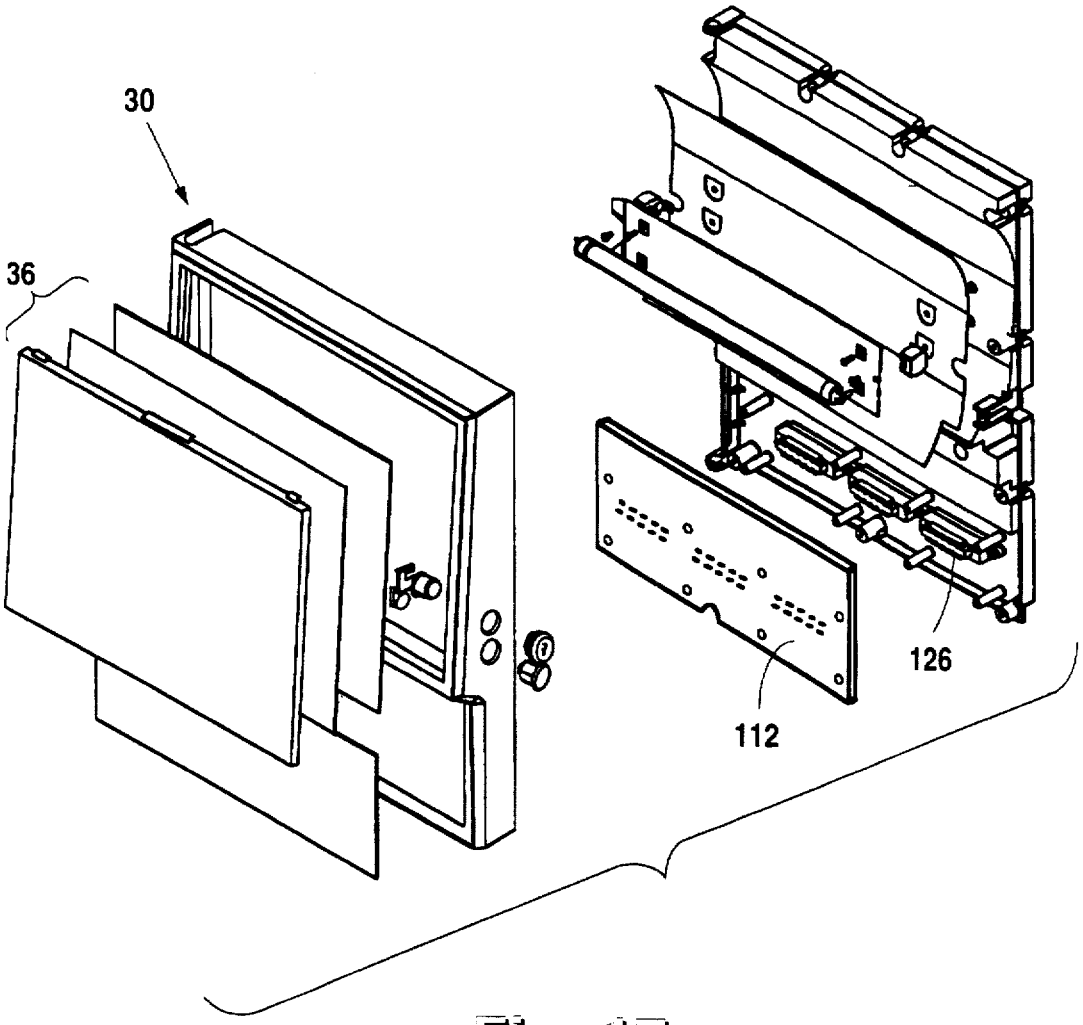
FIG. 17 is an exploded, perspective view of the door.
Figure 14:
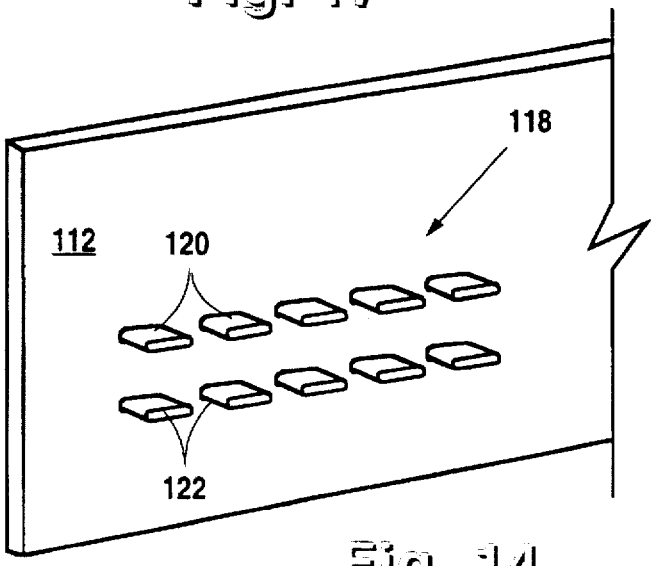
FIG. 14 is a partial rear perspective view of a pc board according to the present invention.
Figure 16:
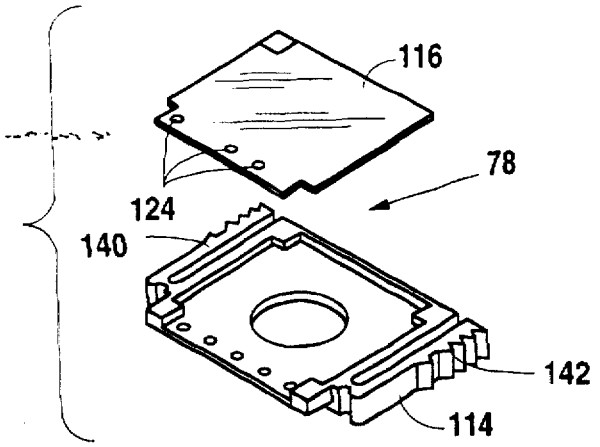
FIG. 16 is a perspective, exploded view of a ratio card of the present invention.
Figure 15:
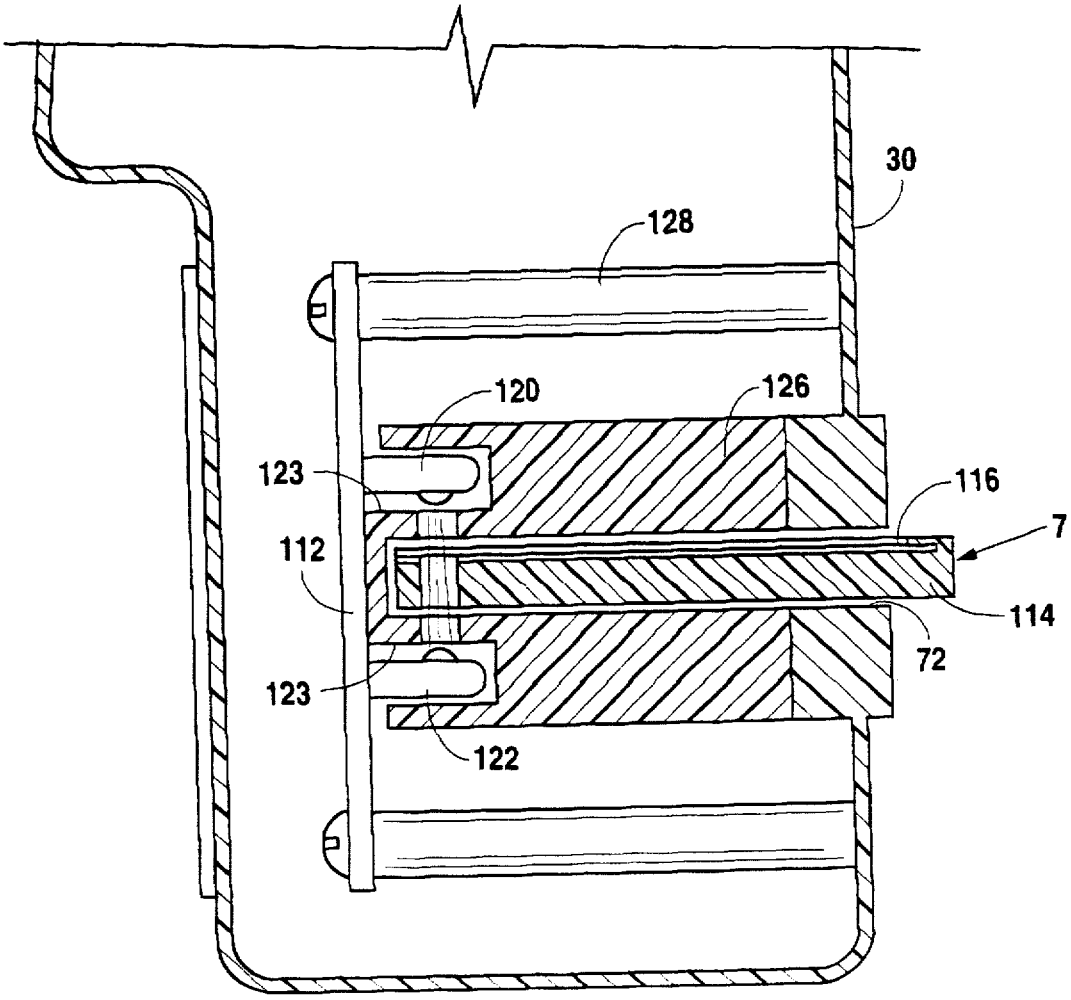
FIG. 15 is a partial cross-sectional side view through a lower portion of the door.

FIG. 12 is a cross-sectional front view taken along line 12—12 of FIG. 13. FIG. 12 shows the compartment 18, the water inlet line 51, the manifold 54, the three lines 56 from the manifold to the three fittings 62. The portion of the lines 56 that contain the solenoid/water meter assembly is not shown.

FIG. 13 is a cross-sectional side view taken along line 13—13 of FIG. 12. FIG. 13 shows the compartment 18, the tank 13, the water inlet line 51, the water outlet line 56, and the couplings 146 and 148 to the water inlet line 51 and water outlet line 52 respectively.

One aspect of this invention is the structural subassembly 134 shown in FIGS. 12 and 13 and the method of making it. It includes the two separately formed elements of the tank 13 and the compartment 18, which are then bonded together at 130 and the various conduits attached and the insulation layer 132 is then foamed in place. This provides, among other advantages, the need during assembly of the dispenser 10 to have to handle only a single unit rather than separately handling each of the individual parts thereof, and also excellent casual drink performance because the water line from the cooling coil 50 to the fitting 62 is insulated along its entire length or is located in the cooled compartment 18.

FIGS. 14-17 show the door 30, the back-lighted graphics panel 36, and the three slots 79 for receiving the ratio card 78. Each of the slots 79 is located inside of a card receiver 126 mounted inside the door. A pc board 112 is mounted on pins 128 inside the door adjacent the card receivers. The pc board includes three series of 5 pairs of emitter pins 120 and receiver pins 122 which project out from the pc board and which extend into grooves 123 in ends of the card receivers. The ratio card 78 includes a card holder 114 and a flexible, removable card 116. The flexible cards are bent slightly and then inserted into the card holder and allowed to snap back flat under recesses in the sides of the card holder to hold them in place. Each card has one or more holes 124 corresponding to a certain product. When the card is inserted, the IR radiation will be received by only certain ones of the receiver pins (corresponding to the holes in the card 116) and this tells the control system what the ratio should be for that product. That is, when the control circuit receives information from the a flow meter as to how much water is flowing, the control circuit will then control the speed of the peristaltic pump motor 84 to provide that desired ratio of water to product.

The card holders 114 include a pair of flexible arms 140 and 142 for holding the ratio card in place. The card holder 114 has five holes and the card 116 can have any number and arrangement of holes up to five. Preferably each card 116 can be used for two different ratios of products, one on each side. That is, by turning the card over, a different arrangement of holes is provided.

In operation, the door 30 is opened and a package 20 is inserted into the compartment 18. The package is oriented so that the tube 74 hangs down. The plate 90 is opened, the tube is guided into place and the plate is closed. Then the tube is guided through the pump 82 by pulling out the locking knob 150 and moving the curved plate 152 to the right about the hinge 154. The plate is then returned and the knob allowed to re-lock. The tube is then guided through the shut-off 80 and the nozzle 70, and the closed end cut off as by a pair of scissors. The shut-off is opened by turning the latch 94 and opening the door 92. As is known, a finger (not shown) on the rear of the door 92 abuts a second, solenoid operated finger to squeeze the tube shut. The solenoid (not shown) pulls the second finger back to allow the tube to open when a beverage is dispensed into the cup 8.

Figure 18A:
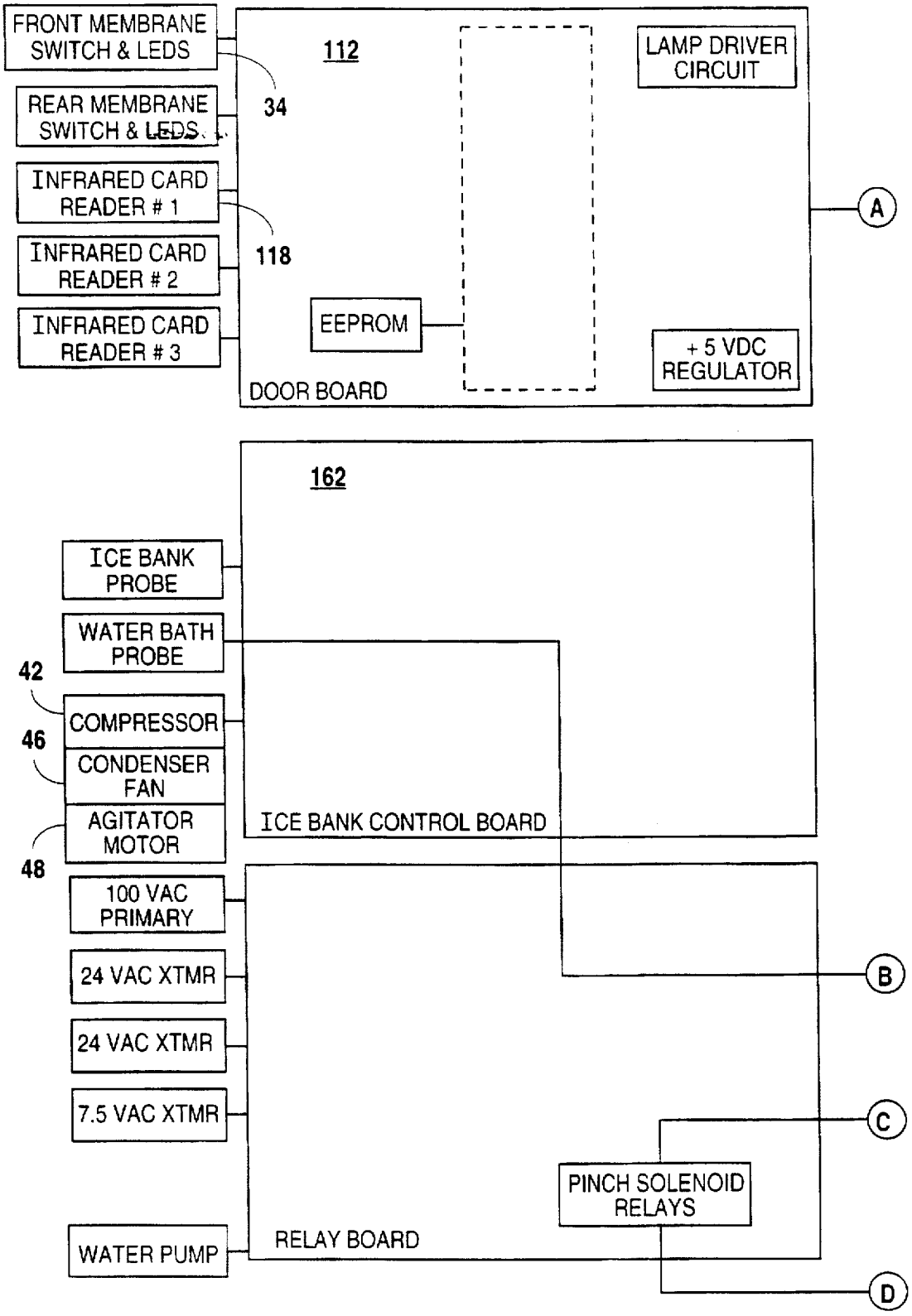
FIG. 18 (FIGS. 18A and 18B) is a block diagram of the electrical control system.
Figure 18B:
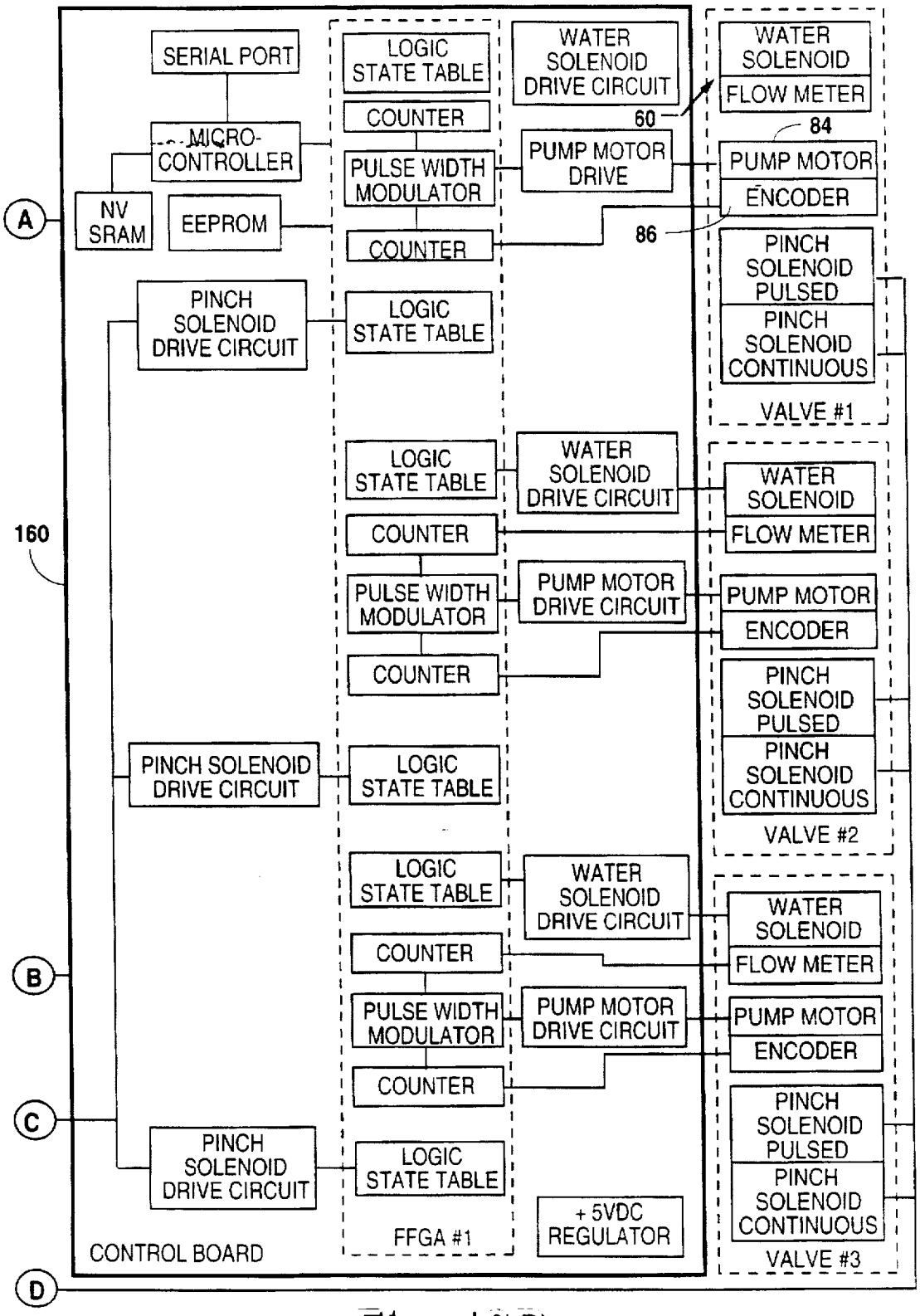

FIG. 18 (FIGS. 18A and 18B) is a block diagram of the control system 24. The electronics consists of four interconnected Printed Circuit Boards (PCB's):

1) Control Board 160—located above the splash plate 11 inside the housing 12.

2) Door Board 112—located inside the door 30

3) Relay Board—located inside the transformer box

4) Ice Bank Control Board 162—located on the refrigeration deck 47.

The Control Board 160 has an on-board microprocessor (uP) with resident memory linked to a Field Programmable Gate Array (FPGA), a serial EEPROM (which loads the FPGA program upon power-up), a non-volatile SRAM which stores system operating variables, and various peripheral circuitry to control the pump motors 84, the pinch solenoids behind the shut-off 80, water pump, water solenoids in the solenoid/water flow meter assemblies 60, and door annunciators. Input to the Control Board comes from the door membrane switches (front and rear), the ratio cards 78, low water bath signal, water flow meters in the solenoid/water flow meter assemblies 60, and pump motor encoders 86. Additionally, three serial communication ports (one per valve) are located on the Control Board to allow a handheld programmer to be linked with the uP to modify such features as the dispense ratio, the low product parameters, the dispense size, etc. The Control Board is connected to all other PCB's, pump motors/encoders, water flow meters, and water solenoids in the system via hardwired cable connections.

The Control Board 160 contains a +5 VDC regulator circuit which converts the 7.5 VAC power from the Relay Board. A green LED on the front of the Control Board indicates whether or not the +5 VDC power is present. Additionally, the 24 VAC from the Relay Board is converted to DC via two bridge diode modules; a red LED indicates the presence of the +24 VDC (unregulated) power which drives the pump motors 84 and water solenoids.

The Door Board 112 consists of an FPGA, a small 8-bit uP (to monitor the FPGA), a serial EEPROM (which loads the FPGA program upon power-up), and various peripheral circuitry such as the infrared ratio card readers, the fluorescent light (for the display panel 36) drive electronics, the LED annunciators, and the associated push-button switch circuitry. All communication between the Door Board 112 and the Control Board 160 is via a two-wire serial link.

The Relay Board serves as the high voltage switcher for the pinch solenoids and the water pump. In addition, the Relay Board routes power from the primary AC voltage input to the power transformers inside the transformer box and to the compressor deck. The Relay Board also connects the low voltage side of the AC power transformers to the Control Board 160.

The Ice Bank Control Board 162 is a self-contained control board which turns the refrigerator compressor on/off based on the electrically sensed size of the ice bank inside the water bath in a well-known fashion. Only one signal is routed external to the main Control Board, that being the low water bath signal.

It will be understood from the above description that the present invention eliminates the need for a refractometer and Brix cups. The present invention provides more accurate ratio control. This dispenser can also dispense two drinks simultaneously whereas previous dispensers that did not use a flow meter with feed back to the motor speed controller could not.

While the preferred embodiment of this invention has been described above in detail, it is to be understood that variations and modifications can be made therein without departing from the spirit and scope of the present invention.

What is claimed is:

1. A postmix beverage dispenser comprising:

(a) a housing;

(b) a water bath tank in said housing for holding an ice-water bath;

(c) a refrigeration system in said housing for forming an ice bank in said tank;

(d) a potable water circuit in said housing including a potable water cooling coil located in said tank;

(e) a concentrate compartment in said housing including a plurality of concentrate package stations, each adapted to hold a removable concentrate package of the type having a flexible dispensing tube;

(f) a plurality of concentrate pumping units in said housing;

(g) said concentrate pumping units each including a peristaltic pump driven by a variable speed gearhead motor with an encoder;

(h) said potable water circuit including a solenoid/water meter assembly;

(i) a control system in said housing receiving signals from said water meter for varying the speed of said motor to provide the desired ratio of water to concentrate;

(j) means for inputting into said control system the desired water to concentrate ratio of the product in each of any concentrate packages located in said compartment; and (k) wherein said inputting means includes a removable ratio card for each concentrate package, a separate slot in said housing corresponding one each to said concentrate package stations, and said control system including means for reading the ratio stored on said ratio cards.

2. The dispenser as recited in claim 1 wherein said housing includes a front door hinged to said housing and providing access to said compartment, and wherein each of said slots is located on the rear surface of said door in front of a corresponding one of said stations.

3. The dispenser as recited in claim 2 wherein each of said ratio cards includes a card holder and a removable flexible card having the ratio information thereon.

4. The dispenser as recited in claim 3 wherein said ratio information is stored on said card in the form of holes.

5. The dispenser as recited in claim 4 wherein said control system includes a pc board mounted on said door and said means for reading the ratio includes a series of pairs of spaced-apart IR emitter-receiver pins mounted on and extending out from said pc board, and said slots being located to position said holes on said ratio cards in-between said pairs of emitter-receiver pins.

6. A postmix beverage dispenser comprising:

(a) a housing;

(b) a water bath tank in said housing for holding an ice-water bath;

(c) a refrigeration system in said housing for forming an ice bank in said tank;

(d) a potable water circuit in said housing including a potable water cooling coil located in said tank;

(e) a concentrate compartment in said housing including a plurality of concentrate package stations, each adapted to hold a removable concentrate package of the type having a flexible dispensing tube;

(f) a plurality of concentrate pumping units in said housing;

(g) said concentrate pumping units each including a peristaltic pump driven by a variable speed gearhead motor with an encoder;

(h) said potable water circuit including a solenoid/water meter assembly;

(i) a control system in said housing receiving signals from said water meter for varying the speed of said motor to provide the desired ratio of water to concentrate;

(j) a system for cooling said compartment, said system including a compartment cooling coil located in said compartment, a fan/motor unit for circulating the air in said compartment through said compartment cooling coil, a pump in said water bath tank, an inlet water conduit extending from said pump to said compartment cooling coil and an outlet water conduit extending from said compartment cooling coil to said tank; and (k) both of said conduits being either below said refrigeration deck or embedded in insulation, whereby neither of said water conduits can sweat and drip condensed water anyplace other than back into said tank.

7. A postmix beverage dispenser comprising:

(a) a housing;

(b) a water bath tank in said housing for holding an ice-water bath;

(c) a refrigeration system in said housing for forming an ice bank in said tank;

(d) a potable water circuit in said housing including a potable water cooling coil located in said tank;

(e) a concentrate compartment in said housing including a plurality of concentrate package stations, each adapted to hold a removable concentrate package of the type having a flexible dispensing tube;

(f) a plurality of concentrate pumping units in said housing;

(g) said concentrate pumping units each including a peristaltic pump driven by a variable speed gearhead motor with an encoder;

(h) said potable water circuit including a solenoid/water meter assembly;

(i) a control system in said housing receiving signals from said water meter for varying the speed of said motor to provide the desired ratio of water to concentrate;

(j) said refrigeration system including an evaporator coil located in the lower portion of said tank; and (k) said potable water cooling coil being located entirely above said evaporator coil whereby it can be removed vertically upwardly from said water bath tank without requiring any work to be done on said evaporator coil.

8. The dispenser as recited in claim 7 wherein said refrigeration system includes a deck on top of said tank and an agitator motor mounted on said deck and an agitator shaft extending down from said agitator motor into said tank, with an agitator blade on the distal end of said shaft.

9. The dispenser as recited in claim 8 wherein said potable water circuit includes coupling means on each end of said potable water cooling coil whereby upon disconnecting said coupling means, said coil can be lifted up out of said tank when said deck has been removed.

10. A postmix beverage dispenser comprising:

(a) a housing;

(b) a water bath tank in said housing for holding an ice-water bath;

(c) a refrigeration system in said housing for forming an ice bank in said tank;

(d) a potable water circuit in said housing including a potable water cooling coil located in said tank;

(e) a concentrate compartment in said housing including a plurality of concentrate package stations, each adapted to hold a removable concentrate package of the type having a flexible dispensing tube;

(f) a plurality of concentrate pumping units in said housing;

(g) said concentrate pumping units each including a peristaltic pump driven by a variable speed gearhead motor with an encoder;

(h) said potable water circuit including a solenoid/water meter assembly;

(i) a control system in said housing receiving signals from said water meter for varying the speed of said motor to provide the desired ratio of water to concentrate; and (j) a plurality of potable water outlet lines extending from said potable water cooling coil to a distal end thereof adjacent a respective one of said concentrate pumping units, each of said potable water outlet lines extending throughout its entire length either in said water bath tank, said compartment or in insulation, whereby said entire length is kept cold to provide excellent casual drink performance of said dispenser.

11. A postmix beverage dispenser comprising:

(a) a housing;

(b) a water bath tank in said housing for holding an ice-water bath;

(c) a refrigeration system in said housing for forming an ice bank in said tank;

(d) a potable water circuit in said housing including a potable water cooling coil located in said tank;

(e) a concentrate compartment in said housing including a plurality of concentrate package stations, each adapted to hold a removable concentrate package of the type having a flexible dispensing tube;

(f) a plurality of concentrate pumping units in said housing;

(g) said concentrate pumping units each including a peristaltic pump driven by a variable speed gearhead motor with an encoder;

(h) said potable water circuit including a solenoid/water meter assembly;

(i) a control system in said housing receiving signals from said water meter for varying the speed of said motor to provide the desired ratio of water to concentrate; and (j) said potable water circuit including a plurality of removable nozzles connected to said housing adjacent respective ones of said pumping units, said water circuit including a manifold, a water line connecting said potable water cooling coil to said manifold, and a plurality of water conduits connecting said manifold to respective fittings, and said nozzles being removably attached to respective ones of said fittings, said nozzles each including a central opening for receiving said tube and a plurality of circumferentially spaced-apart water discharge ports each aimed inwardly toward the axis of said central opening.

12. The dispenser as recited in claim 11 wherein each of said nozzles includes a slot leading into said central opening.

13. The dispenser as recited in claim 12 wherein each of said nozzles includes a pair of flexible arms, one on each side thereof, and locking means on said arms for holding said nozzles in place.

14. A postmix beverage dispenser comprising:

(a) a housing;

(b) a water bath tank in said housing for holding an ice-water bath;

(c) a refrigeration system in said housing for forming an ice bank in said tank;

(d) a potable water circuit in said housing including a potable water cooling coil located in said tank;

(e) a concentrate compartment in said housing including a plurality of concentrate package stations, each adapted to hold a removable concentrate package of the type having a flexible dispensing tube;

(f) a plurality of concentrate pumping units in said housing;

(g) said concentrate pumping units each including a peristaltic pump driven by a variable speed gearhead motor with an encoder;

(h) said potable water circuit including a solenoid/water meter assembly;

(i) a control system in said housing receiving signals from said water meter for varying the speed of said motor to provide the desired ratio of water to concentrate; and (j) means for inputting into said control system the desired water to concentrate ratio of the product in each of any concentrate packages located in said compartment.

15. A postmix beverage dispenser comprising:

(a) a housing;

(b) a water bath tank in said housing for holding an ice-water bath;

(c) a refrigeration system in said housing for forming an ice bank in said tank;

(d) a potable water circuit in said housing including a potable water cooling coil located in said tank;

(e) a concentrate compartment in said housing including a plurality of concentrate package stations, each adapted to hold a removable concentrate package of the type having a flexible dispensing tube;

(f) a plurality of concentrate pumping units in said housing;

(g) said concentrate pumping units each including a peristaltic pump driven by a variable speed gearhead motor with an encoder;

(h) said potable water circuit including a solenoid/water meter assembly;

(i) a control system in said housing receiving signals from said water meter for varying the speed of said motor to provide the desired ratio of water to concentrate;

(j) means for inputting into said control system the desired water to concentrate ratio of the product in each of any concentrate packages located in said compartment; and (k) said housing including a removable splash plate and said control system including a control box located behind said splash plate, said solenoid/water meter assembly being located in the rear of said compartment, and said pumping units being accessible from the front of said dispenser, whereby the major components of said dispenser are serviceable from either the front or top of said housing.

16. A method for making a major subassembly of a postmix beverage dispenser, said portion comprising a water-bath tank, a separate concentrate package compartment, a plurality of water conduits external to both said tank and said compartment, and a layer of insulation surrounding said tank and compartment and conduits, comprising the steps of:

(a) forming said tank;

(b) forming said compartment;

(c) bonding said tank to said compartment;

(d) positioning said conduits in place; and (e) foaming in place said layer of insulation surrounding said tank, said compartment and said conduits, to form a one-piece, structural subassembly.

17. A one piece, structural subassembly for a postmix beverage dispenser comprising:

(a) a water bath tank;

(b) a concentrate package compartment;

(c) said tank and said compartment being bonded together;

(d) a plurality of conduits external to said tank and said compartment; and (e) a layer of foamed-in-place insulation surrounding said tank, compartment and conduits.

* * * * *